United States Patent [19]

Ashe et al.

[11] 4,257,757

[45] Mar. 24, 1981

[54] RADIANT COMBUSTOR ASSEMBLY

[75] Inventors: Thomas L. Ashe; Byron B. Heath, both of Scottsdale, Ariz.

[73] Assignee: The Garrett Corporation, Los Angeles, Calif.

[21] Appl. No.: 916,165

[22] Filed: Jun. 16, 1978

[51] Int. Cl.[2] ..... F23D 13/12

[52] U.S. Cl. ..... 431/7; 431/328; 126/92 AC

[58] Field of Search ..... 431/328, 329; 126/92 R, 126/92 AC

[56] References Cited

U.S. PATENT DOCUMENTS

| | | | |
|---|---|---|---|
| 1,222,922 | 4/1917 | Bone et al. | 431/328 |
| 3,027,936 | 4/1962 | Lamp, Jr. | 431/328 |
| 3,098,477 | 7/1963 | Lotter | 431/328 |
| 3,151,659 | 10/1964 | Ravich | 431/329 |
| 3,407,023 | 10/1968 | Hirschberg et al. | 431/328 |
| 3,857,669 | 12/1974 | Smith et al. | 431/328 |

*Primary Examiner*—Carroll B. Dority, Jr.
*Assistant Examiner*—Lee E. Barrett
*Attorney, Agent, or Firm*—Stuart O. Lowry; James W. McFarland; Albert J. Miller

[57] ABSTRACT

A radiant combustor assembly including a generally planar porous combustor element for burning an air-fuel mixture on the surface thereof without combustion flash back.

31 Claims, 8 Drawing Figures

RADIANT COMBUSTOR ASSEMBLY

BACKGROUND OF THE INVENTION

This invention relates to radiant combustors. More specifically, this invention relates to a combustor assembly particularly for use with heat engines.

Heat engines in general are well-known in the prior art, and typically comprise engines of either the open or closed cycle type wherein heat is transferred to an engine working fluid. For example, in an open cycle heat engine such as a gas turbine, a mixture of fuel and an oxidizer such as air is burned in a combustion chamber, and the burned products of combustion are used to heat an engine working fluid. Specifically, the products of combustion are mixed with excess air to form a heated working fluid which is expanded through an expansion turbine to obtain a work output. In a closed cycle heat engine such as a steam engine, closed cycle Brayton engine, or the like, the fuel and air mixture is burned in a combustion chamber for heating an engine working fluid, such as air or water, by heat exchange through a fixed boundary without intermixture between the combustion products and the working fluid.

A major problem with fuel-burning heat engines comprises the presence of noxious pollutants in the products of combustion. More specifically, combustion of the fuel is normally incomplete whereby polluting exhaust emissions such as unburned hydrocarbons, carbon monoxide, and oxides of nitrogen are present. In the prior art, heat engines have been designed to produce satisfactorily low levels of unburned hydrocarbons and carbon monoxide, but the levels of oxides of nitrogen have remained objectionably high. The presence of nitrogen oxides is largely due to the relatively long flame residence times and high flame temperatures, typically about 4000° R. or more, of conventional flame propagation-type combustors.

In some prior art combustion applications, radiant surface combustors have been used in lieu of traditional flame propagation-type combustors, and have exhibited improved exhaust emission characteristics, particularly with regard to the presence of oxides of nitrogen. That is, some prior art combustors have been proposed wherein a pressurized gaseous fuel-air mixture is forced through a porous combustor element, and wherein combustion occurs generally at the surface of the combustor element to produce primarily radiant heat energy. See for example, U.S. Pat. Nos. 1,223,308; 3,027,936; 3,063,493; 3,155,142; 3,179,156; 3,191,659; 3,208,247; 3,217,701; 3,231,202; 3,275,497; 3,383,159 and 3,650,661. However, these prior art applications of radiant surface combustors have generally been limited to space-heater type applications. Radiant surface combustors have not been used with heat engines since they have been generally incapable of providing sufficient quantities of radiant heat energy at a sufficiently high temperature level for satisfactory operation of a heat engine. Moreover, prior art radiant combustors which have been designed for producing large quantities of radiant heat have exhibited an undesirable tendency toward flash back of the flame front upstream of the porous element. Such flash back detrimentally affects both the efficiency and the operating life of the combustor system.

The present invention overcomes the problems and disadvantages of the prior art by providing a radiant surface combustor assembly which is quickly and easily assembled, which produces relatively large quantities of radiant heat energy for use in a heat engine, and which includes means for preventing combustion flash back.

SUMMARY OF THE INVENTION

In accordance with the invention, a radiant combustor assembly comprises a substantially planar porous combustor element mounted upon a channeled backing and fuel-air distribution plate. A dual manifold is coupled to the backing plate, and includes an air plenum and a fuel plenum for receiving pressurized air and fuel, respectively. The air and fuel are mixed substantially at stoichiometric proportion by fuel injector apparatus communicating with said plenums, and which includes an acceleration nozzle through which the resulting mixture is supplied to distribution channels in the backing plate. The distribution channels spread the accelerated fuel-air mixture for substantially uniform passage through the combustor element over substantially the entire area thereof. The mixture is ignited on the downstream surface of the combustor element to produce large quantities of radiant heat energy, with the acceleration nozzle assuring that the velocity of the mixture through the element is sufficient to prevent flash back of the flame front.

In a preferred embodiment, a plurality of generally U-shaped brackets are provided for retaining the backing plate and the combustor element in close parallel relation with each other under substantially uniform pressure. A plurality of spring-loaded pins serve to position the brackets, and to align and retain the dual manifold with respect to the backing plate and combustor element. Preferably, insulation is positioned between the backing plate and the manifold to prevent heat soakback from the combustor element, and thereby also help to prevent flame flash back.

The radiant combustor assembly is adapted for mounting within the combustor of a heat engine. The radiant combustor assembly may be positioned alone, or with one or more additional radiant combustor assemblies, for supplying relatively large quantities of radiant heat energy to a working fluid for the heat engine.

BRIEF DESCRIPTION OF THE DRAWINGS

The accompanying drawings illustrate the invention. In such drawings.

DETAILED DESCRIPTION OF THE PREFERRED EMBODIMENT

Figure 1:
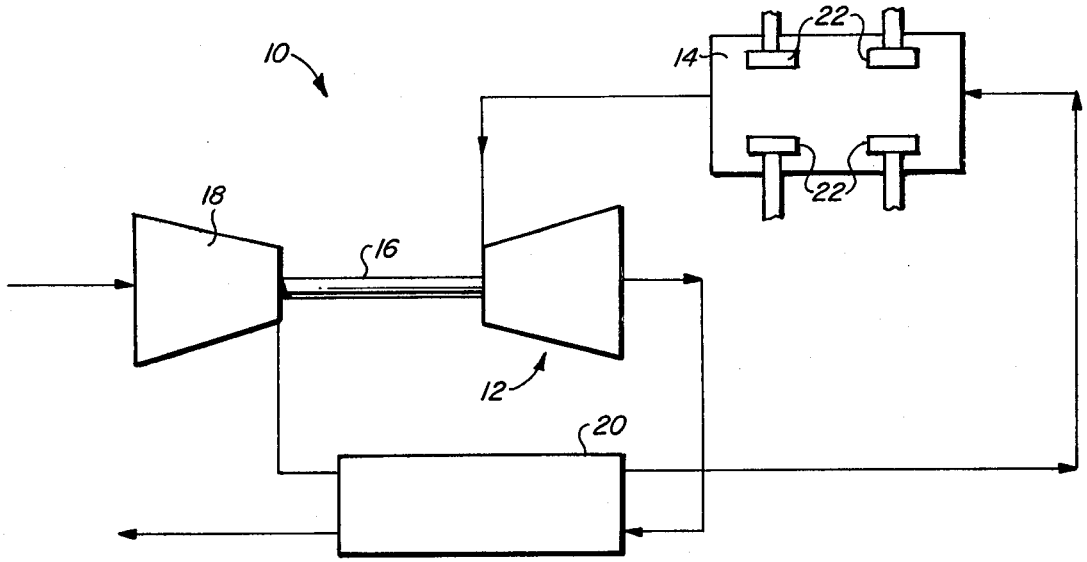
FIG. 1 is a schematic diagram of a heat engine system, including radiant combustor assemblies of this invention.

A heat engine system 10 is shown schematically in FIG. 1, and generally comprises a power output section 12 to which a heated working fluid is supplied from a combustor 14. In the system shown, the power output section 12 comprises a power turbine which is rotatably driven at high speeds by the working fluid. The turbine 12 is mounted on a common shaft 16 with a compressor(s) 18 which draws in and compresses ambient air. The air comprises the working fluid for the engine, and is supplied to the combustor 14 for addition of heat energy to the air prior to supply to the power turbine 12. Desirably, the air provided to the combustor 14 is first supplied through a heat exchanger, such as a recuperator 20, to pick up additional heat from the power turbine exhaust.

The combustor 14 includes one or more radiant combustor assemblies 22 of this invention for providing relatively large quantities of radiant heat energy to the working fluid, with relatively low levels of noxious pollutants in the products of combustion. Importantly, the radiant combustor assemblies 22 may be adapted for operation of the heat engine system 10 as either an open cycle or a closed cycle engine. That is, each radiant combustor assembly is supplied with a combustible fuel-air mixture, which may include working fluid air supplied by the compressor 18, or may be supplied by alternate means. In an open cycle engine, the products of combustion are mixed with the working fluid and the mixture is supplied to the power turbine 12, whereas in a closed cycle engine the products of combustion and the working fluid are isolated from each other. For examples of open and closed cycle radiant combustors, see U.S. patent application Ser. No. 916,161, filed concurrently herewith in the name of Rackley et al, and assigned to the assignee of this application.

Figure 2:
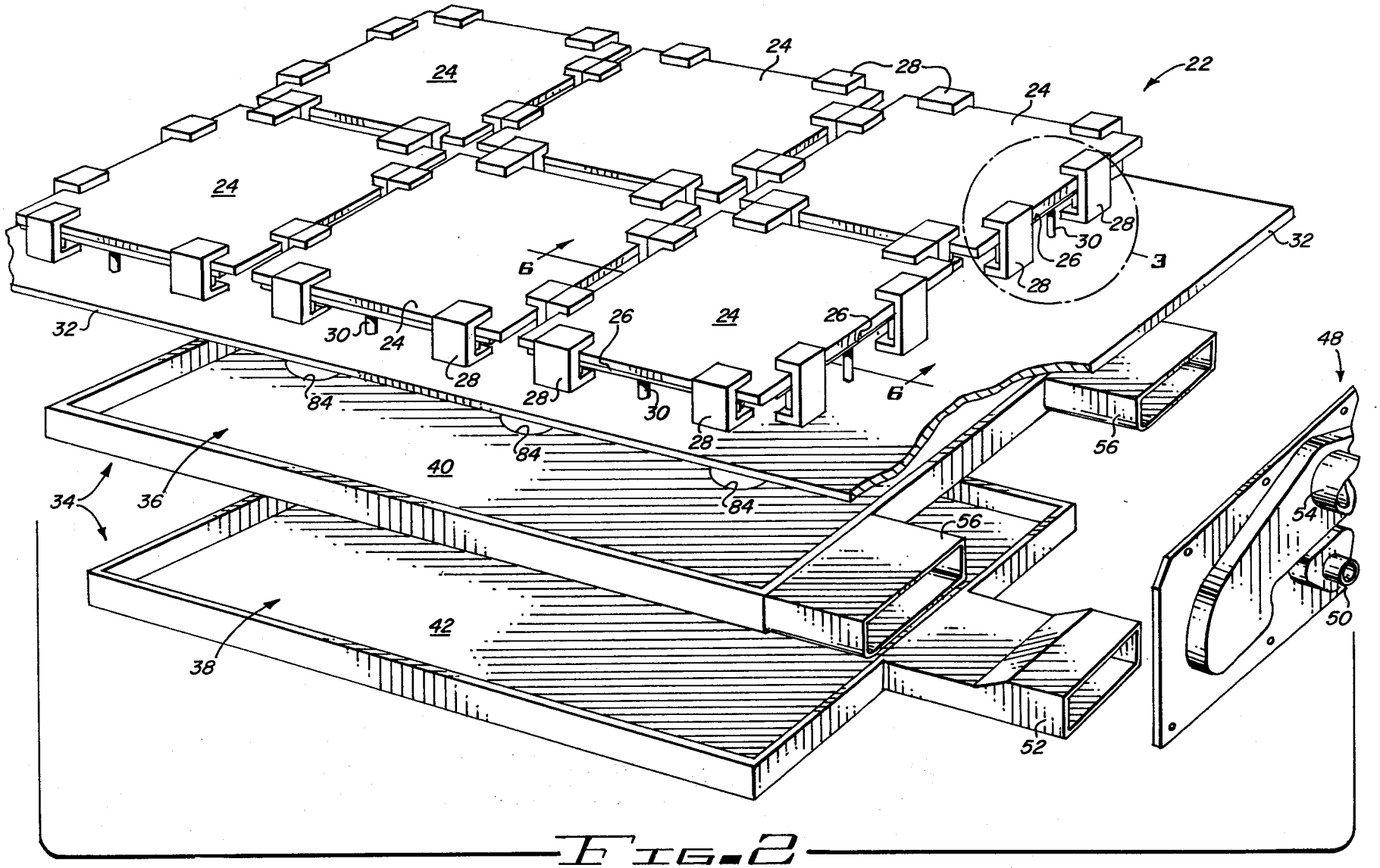
FIG. 2 is an exploded perspective view of a radiant combustor assembly, with portions broken away.

A radiant combustor assembly 22 of this invention is shown in more detail in FIG. 2. As shown, the assembly 22 comprises a plurality of generally rectangular porous combustor elements 24 each mounted over a generally correspondingly shaped backing plate 26 by a series of brackets 28. The brackets 28 are in turn secured by bolts 30 to a relatively large mounting plate 32 forming the top plate for a dual manifold 34. The manifold 34 includes an air plenum 36 and a fuel plenum 38 for receiving air and fuel, respectively, for supply to the combustor elements 24 for combustion, as will be hereafter described.

Figure 6:
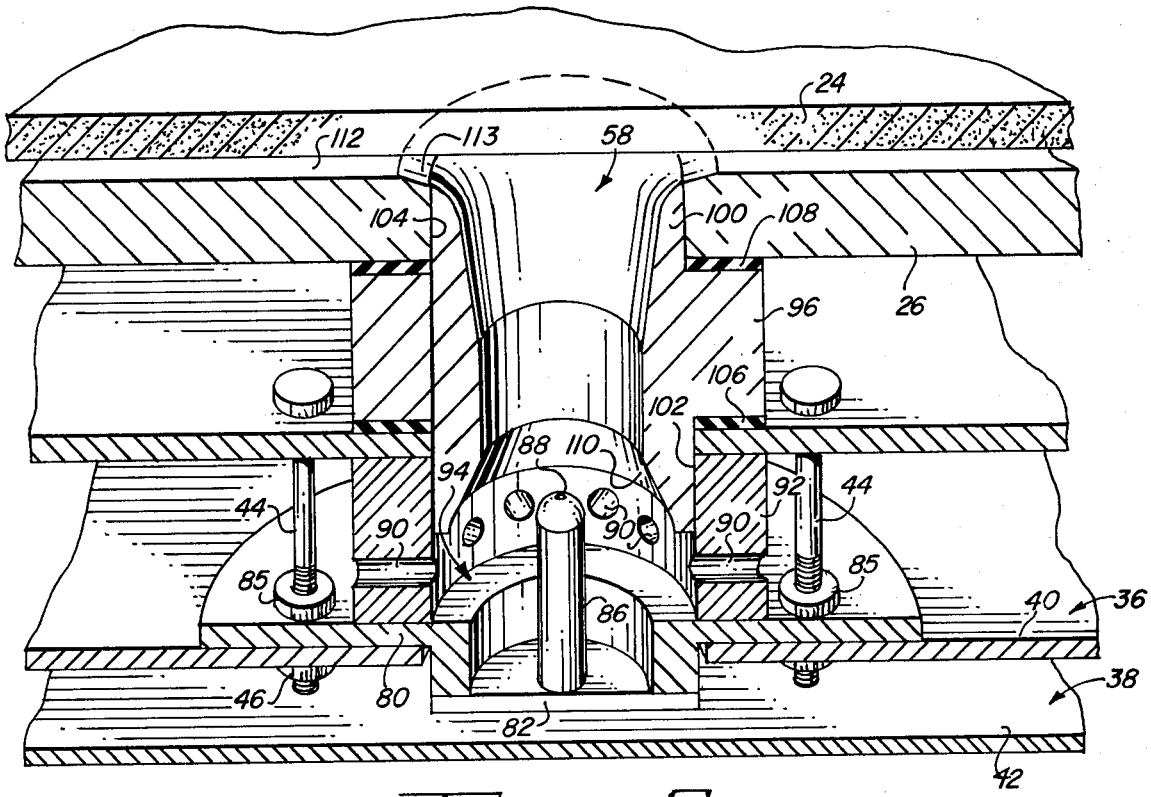
FIG. 6 is an enlarged somewhat sectional view taken generally on the line 6—6 of FIG. 2.

As shown in FIGS. 2 and 6, the air plenum 36 and the fuel plenum 38 are formed from relatively shallow, tray-like members 40 and 42, respectively, with the air plenum member 40 being seated on top of the fuel plenum member 42. This provides an extended, relatively closed volume forming the fuel plenum 38 for receiving a suitable gaseous or vaporized fuel. The mounting plate 32 is in turn seated on top of the air plenum member 40 to similarly provide an extended, relatively closed volume forming the air plenum 36. Conveniently, the air and fuel plenum members 40 and 42, and the mounting plate 32 are rigidly connected with respect to each other as by a plurality of bolts 44 including nuts 46 to form the dual manifold 34. Alternately, if desired, said plenum members may be attached as by welding, or by other means.

Figure 3:
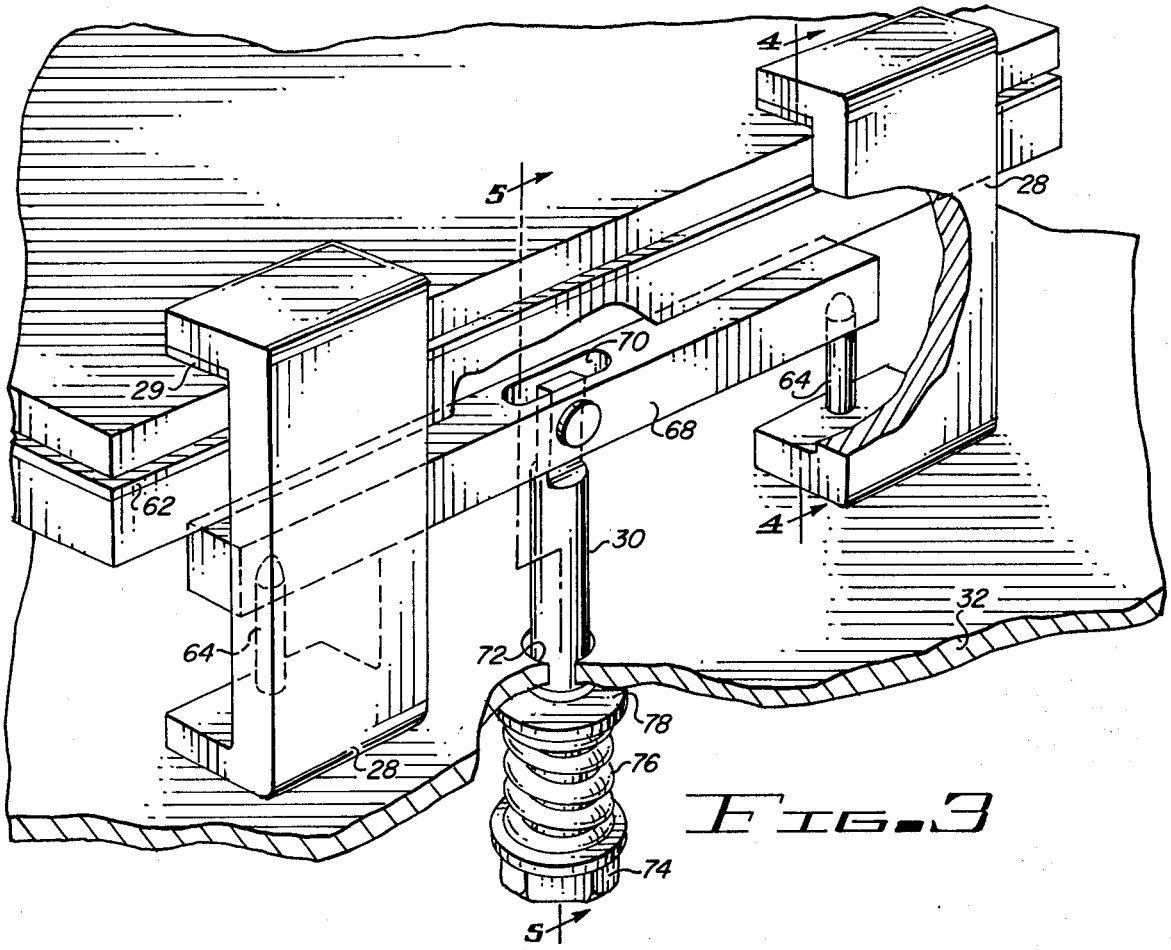
FIG. 3 is an enlarged fragmented perspective view of a portion of FIG. 2, with portions broken away.
Figure 4:
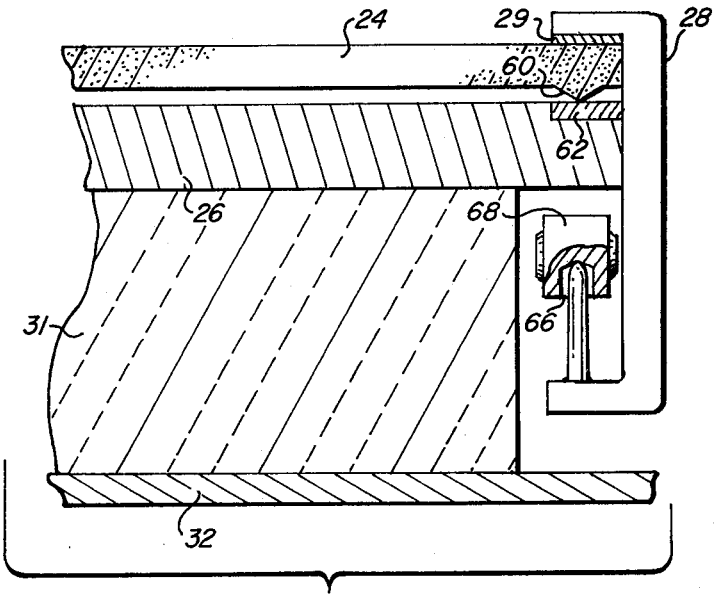
FIG. 4 is a fragmented vertical section taken on line 4—4 of FIG. 3.
Figure 5:
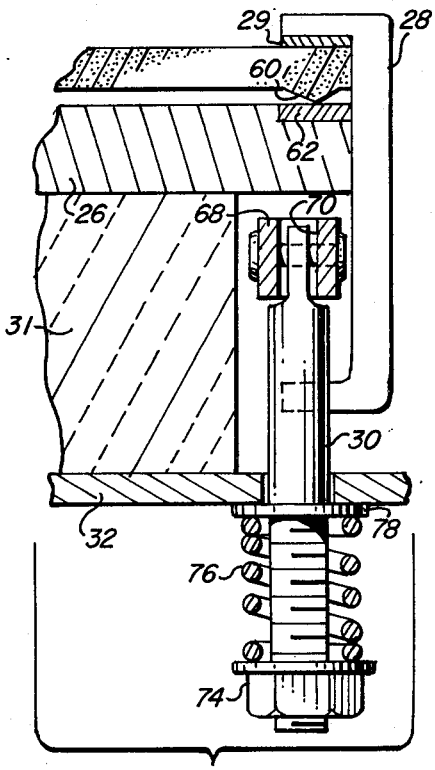
FIG. 5 is a fragmented vertical section taken on the line 5—5 of FIG. 3.

As shown in FIGS. 3–5, the combustor elements 24 and the backing plates 26 are connected to the mounting plate 32 by the bolts 30, with a layer of a suitable insulating material 31 being provided between the combustor elements 24 and the mounting plate 32 to help prevent soak back of heat from the elements. More specifically, each of the combustor elements 24 includes a downwardly depending peripheral rim 60 which sealingly seats upon a resilient gasket 62 peripherally carried by the associated backing plate 26. A plurality of the brackets 28, which are generally U-shaped, are received over the upper outer edges of the combustor elements 24, and extend downwardly therefrom each including an upstanding pin 64. As shown in the preferred embodiment, there are two brackets 28 at each outer edge of each combustor element, and resilient pads 29 are interposed between the brackets 28 and the combustor elements to help protect said elements against breakage. The brackets 28 have their respective pins 64 received in lower recesses 66 at opposite ends of a stabilizer bar 68. The stabilizer bar 68 includes a central slot 70 for reception of the upper end of one of the bolts 30 which is pivotably mounted to the bar. The bolt 30 extends downwardly therefrom through an opening 72 in the mounting plate 32, and is secured with respect thereto by a nut 74. Conveniently, a compression spring 76 is interposed between the nut 74 and a washer 78 on the underside of the mounting plate 32. In this manner, the bolts 30 are spring-loaded to tightly retain the combustor elements 24 in uniformly spaced relation with respect to the backing plates 26, and to securely mount the combustor elements, backing plates, and insulation with respect to the mounting plate 32 and the manifold 34.

Air and fuel are supplied to the combustor assembly 22 via a unitary header 48 mounted at one end of the manifold 34. As shown in FIG. 2, the header 48 includes a fuel inlet 50 for receiving a supply of fuel under pressure. The fuel inlet 50 is aligned with a corresponding inlet duct 52 on the fuel plenum member 42 so as to supply the fuel under pressure to the fuel plenum 38. The header 48 also includes an air inlet 54 for receiving compressed air under predetermined pressure from a suitable supply. The air is ducted to the air plenum 36 via an aligned pair of inlet ducts 56 on the air plenum member 40.

The air and fuel in the plenums 36 and 38 is supplied to the combustor elements 24 by a plurality of fuel injector assemblies 58, as shown in FIG. 6. Specifically, one injector assembly 58 is centrally disposed beneath each of the plate-like combustor elements 24 to mix the air and fuel, and to supply the same for passage through said element. Each fuel injector assembly 58 comprises a lower plate 80 including a central well 82 received in an opening 84 in the air plenum member 40. The lower plate 80 forms an enlarged radial flange for receiving the mounting bolts 44, and for retention in place as by lock-nuts 85 received over said bolts 44.

A tubular fuel nozzle 86 upstands from the well 82, and includes a passage 88 through which the fuel is injected from the fuel plenum 38 upwardly into the interior of the injector assembly 58. This nozzle 86 terminates at its upward end generally between the air plenum member 40 and the mounting plate 32, and slightly above a plurality of inwardly radiating air passages 90 formed in a generally cylindrical upstanding wall member 92 of the injector assembly. The wall member 92 is interposed between the air plenum member 40 and the mounting plate 32, and defines a mixing chamber 94 in which the fuel and air become thoroughly mixed. Importantly, because the fuel and air are supplied from relatively low, constant pressure plenums, the mixing of fuel and air is controlled at substantially stoichiometric proportion.

Each fuel injector assembly 58 includes an upper cylinder 96 disposed between the mounting plate 32 and the backing plate 26. The upper cylinder 96 has lower and upper projections 98 and 100 received through corresponding openings 102 and 104 in the mounting plate 32 and the backing plate 26, with the lower projection 98 matingly engaging the lower injector wall member 92. If desired, gasket seals 106 and 108 are provided for sealing the upper cylinder in position without leakage of fuel or air.

The upper fuel injector cylinder 96 comprises an acceleration nozzle for accelerating the air-fuel mixture upwardly toward the underside of the combustor element 24. More specifically, the cylinder 96 includes converging inner walls 110 forming a venturi tube for accelerating the air-fuel mixture. The air-fuel mixture thus has a relatively high velocity flow upon exiting the injector assembly 58 and entering the space 112 between the backing plate 26 and the combustor element 24.

Figure 7:
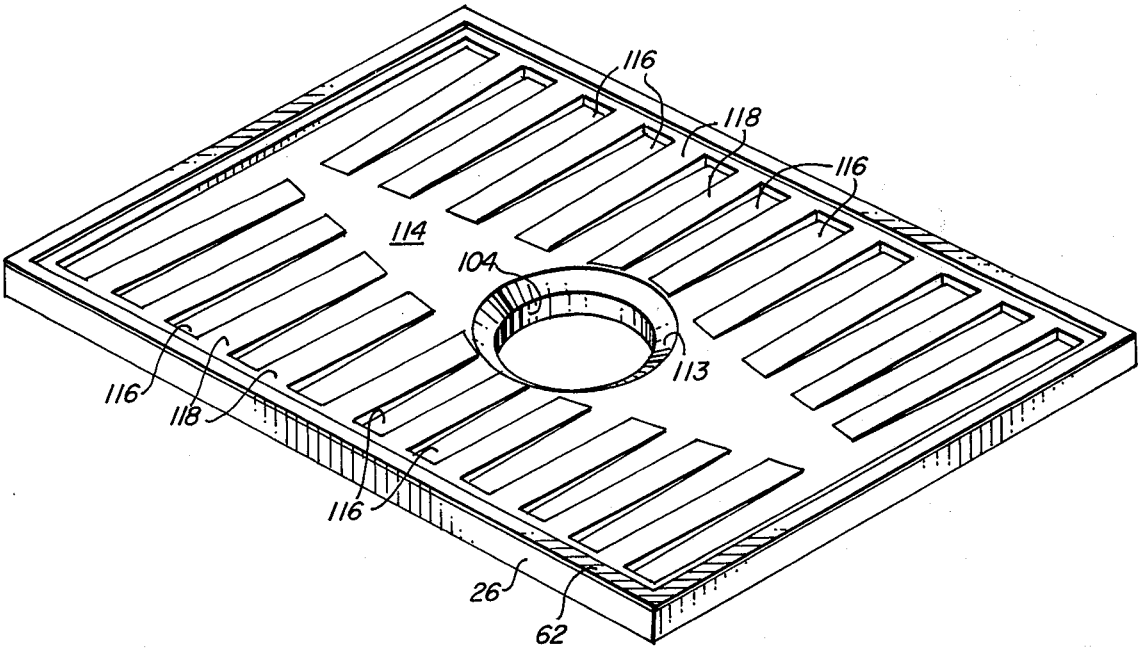
FIG. 7 is a perspective view of a portion of the combustor assembly.

The accelerated air-fuel mixture is uniformly distributed over the upper surface of the backing plate 26, as shown in FIG. 7. As shown, the backing plate 26 includes a formed channel configuration including an outwardly tapered surface 113 surrounding the central opening 104. The surface 113 blends into an open central channel 114 communicating with a plurality of outwardly extending flow channels 116 separated by ridges 118 each having a ramp-shaped profile. In this manner, a substantially uniform air-fuel pressure distribution is obtained on the underside of the combustor element 24 whereby the air-fuel mixture is supplied to the combustor element 24 generally uniformly with respect to its area.

The air-fuel mixture is forced through the porous combustor element 24 under pressure, and is ignited by suitable means (not shown) on the upper surface thereof. Importantly, the accelerated air-fuel mixture has a velocity through the element 24 sufficient to assure against flash back of the flame upstream of the element. The air-fuel mixture, one ignited, continues to burn at the upper surface of the combustor element 24 substantially as a two dimensional flame with short residence time to produce relatively high quantities of radiant heat energy. In this manner, the combustor elements produce sufficient radiant heat for transfer to a heat engine working fluid as illustrated in FIG. 1.

The combustor elements 24 each are formed from a porous ceramic material to include a controlled porosity for passage of the air-fuel mixture. Preferably, the elements are formed from a zirconia, silicon carbide, or silicon nitride ceramic material which has been found to be satisfactory for heat engine applications withstanding temperatures of as high at about 3000° R. The elements may be formed from a variety of techniques including, but not limited to molding, casting with mechanically formed porous passages, and bonding with irregularly shaped particles and/or fibers. The resulting porous element has a porosity, thickness, and shape according to the particular heat engine to be encountered.

Figure 8:
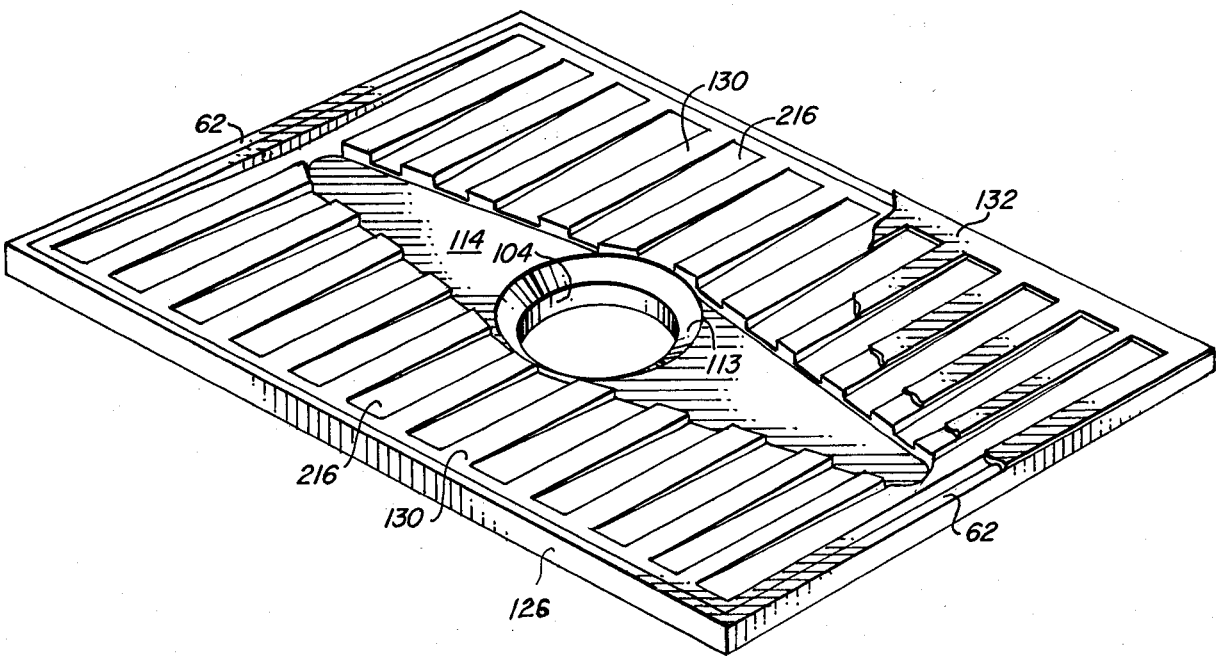
FIG. 8 is a perspective view of an alternate embodiment of a portion of the combustor assembly.

An alternate embodiment of the backing plate is shown in FIG. 8, with like reference numerals referring to like components. As shown, an alternate backing plate 126 has a channeled configuration including a peripheral gasket 62. A central opening 104 directs the accelerated air-fuel mixture to the center of the plate, and blends into a tapered surface 113 communicating with a central flow channel 114. The flow channel 114 communicates with a plurality of outwardly extending, ramped channels 216 which are separated by flat raised lands 130. Conveniently, the lands 130 support an insulating overlay 132 shaped to correspond with the shape of the lands 130, and which serves to protect the lands from heat soak back from the overlying radiant combustor element 24. In this manner, possible flash back of the flame front is further prevented.

A wide variety of modifications and improvements of the radiant surface combustor assembly of this invention are believed to be possible within the scope of the art. For example, a single combustor element may be used with each air-fuel manifold, rather than a plurality of elements per manifold as described above. Accordingly, no limitation of the present invention is intended except by way of the appended claims.

What is claimed is:

1. A radiant combustor assembly comprising a housing forming a manifold for receiving fuel and air under pressure, said manifold including a tray-like fuel plenum member having a fuel inlet, a tray-like air plenum member having an air inlet and mounted on top of said fuel plenum member to form a fuel plenum, and a backing plate mounted on top of said air plenum member to form an air plenum; a generally planar porous combustor element mounted on top of said mounting plate; and means communicating between said manifold and one side of said combustor element for directing fuel and air from said manifold toward said combustor element for passage therethrough and combustion on the other side thereof, said means including acceleration means for accelerating the fuel and air to a velocity sufficient to prevent combustion flash back.

2. A radiant combustor assembly as set forth in claim 1 wherein said means is in communication with both said plenums.

3. A radiant combustor assembly as set forth in claim 2 wherein said means includes a mixing chamber communicating with both said plenums for receiving and mixing fuel and air prior to acceleration by said acceleration means.

4. A radiant combustor assembly as set forth in claim 1 wherein said acceleration means comprises a venturi tube.

5. A radiant combustor assembly as set forth in claim 1 wherein said backing plate is mounted adjacent the one side of said combustor element in parallel, slightly spaced relation therewith, said backing plate having a central opening for receiving fuel and air from said acceleration means, and including a channeled configuration presented toward said combustor element formed to provide a substantially uniform fuel and air pressure distribution over said one of said combustor element.

6. A radiant combustor assembly as set forth in claim 5 wherein said channeled configuration comprises an enlarged central channel communicating with outwardly extending flow channels separated by outwardly ramped ridges.

7. A radiant combustor assembly as set forth in claim 5 wherein said channeled configuration comprises an enlarged central channel communicating with outwardly ramped, outwardly extending flow channels separated by raised lands.

8. A radiant combustor assembly as set forth in claim 7 including an insulating overlay interposed between said backing plate and said combustor element, said overlay corresponding in shape generally to the configuration of said lands.

9. A radiant combustor assembly as set forth in claim 5 including means for maintaining said backing plate in substantially parallel, slightly spaced relation with respect to said combustor element.

10. A radiant combustor assembly as set forth in claim 9 wherein said maintaining means comprises peripheral rim means between said combustor element and said backing plate at their peripheries for spacing the same from each other; a plurality of brackets received over the peripheral edges of said combustor element and backing plate; an insulation layer disposed between said backing plate and said housing; and spring connector means for coupling said brackets to said housing under spring tension so as to draw said plate and element insulation layer toward said housing under spring tension.

11. A radiant combustor assembly as set forth in claim 1 wherein said means comprises a fuel injector assembly mounted on said manifold and centrally disposed with respect to said combustor element.

12. A radiant combustor assembly as set forth in claim 11 including a plurality of combustor elements, and a corresponding plurality of fuel injector assemblies communicating between said manifold and said combustor elements.

13. A radiant combustor assembly as set forth in claim 1 wherein said combustor element is formed from a high temperature, porous ceramic material.

14. A radiant combustor assembly comprising a dual manifold including a fuel plenum and an air plenum for receiving fuel and air, respectively, under pressure; a generally planar porous combustor element mounted on said manifold; an insulation layer interposed between said combustor element and said manifold; and a fuel injector assembly mounted on said manifold and centrally disposed with respect to said combustor element, said injector assembly communicating between both said plenums and one side of said combustor element for mixing and directing fuel and air toward said combustor element for passage therethrough and combustion on the other side thereof, said injector assembly including acceleration means for accelerating the fuel and air to a velocity sufficient to prevent combustion on said one side of said combustor element.

15. A radiant combustor assembly as set forth in claim 14 wherein said acceleration means comprises a venturi tube.

16. A radiant combustor assembly as set forth in claim 14 including a backing plate mounted adjacent the one side of said combustor element in parallel, slightly spaced relation therewith, said backing plate having a central opening for receiving fuel and air from said acceleration means, and including a channeled configuration presented toward said combustor element formed to provide a substantially uniform fuel and air pressure distribution over said one side of said combustor element.

17. A radiant combustor assembly as set forth in claim 16 including spring connector means for maintaining said combustor element and backing plate in position with respect to each other, and with respect to said manifold.

18. A radiant combustor assembly comprising a dual manifold including a fuel plenum and an air plenum for receiving fuel and air, respectively, under pressure; a generally planar porous combustor element; a backing plate mounted adjacent one side of said combustor element in parallel, slightly spaced relation therewith, said backing plate including a channeled configuration presented toward said combustor element; means for mounting said combustor element and said backing plate on said manifold; an insulation layer interposed between said manifold and said backing plate; and a fuel injector assembly mounted on said manifold and centrally disposed with respect to said combustor element and backing plate, said injector assembly communicating between both said plenums and one side of said combustor element for mixing and directing fuel and air toward said combustor element for passage therethrough and combustion on the other side thereof, said channeled backing plate configuration serving to provide a substantially uniform fuel and air pressure distribution over said one side of said combustor element, said injector assembly including acceleration means for accelerating the fuel and air to a velocity sufficient to prevent combustion on said one side of said combustor element.

19. A radiant combustor assembly as set forth in claim 18 wherein said acceleration means comprises a venturi tube.

20. A radiant combustor assembly comprising a dual manifold including a fuel plenum and an air plenum for receiving fuel and air, respectively, under pressure; a plurality of generally planar porous combustor elements; a plurality of backing plates with individual ones of said plates being mounted adjacent one side of individual ones of said combustor elements in parallel, slightly spaced relation therewith, each of said backing plates including a channeled configuration presented toward the one side of the associated combustor element; means for mounting said combustor elements and backing plates on said manifold; an insulation layer interposed between said backing plates and said manifold; and a plurality of fuel injector assemblies mounted on said manifold with individual ones of said injector assemblies being centrally disposed with respect to individual ones of said combustor elements and communicating between both said plenums and the one side of the associated combustor element for mixing and directing fuel and air toward the combustor elements for passage therethrough and combustion on the other side thereof; said channeled backing plate configurations serving to provide a substantially uniform fuel and air pressure distribution over the one side of each combustor element, and said injector assemblies each including acceleration means for accelerating the fuel and air to a velocity sufficient to prevent combustion flash back.

21. A radiant combustor method comprising the steps of supplying fuel and air under pressure to a housing forming a manifold; accelerating the fuel and air from the manifold toward one side of a generally planar porous combustor element for passage therethrough and combustion on the other side thereof, the fuel and air being accelerated to a velocity sufficient to prevent combustion flash back; and interposing an insulation layer between the manifold and the combustor element.

22. The method of claim 21 wherein said supplying step comprises supplying the fuel and air to a fuel plenum and an air plenum, respectively, formed in said housing.

23. The method of claim 24 wherein said accelerating step comprises providing a fuel injector assembly communicating between both said plenums and the one side of said combustor element, and forming a mixing chamber in said injector assembly for mixing the fuel and air prior to acceleration.

24. The method of claim 21 wherein said accelerating step comprises accelerating the fuel and air through a venturi tube.

25. The method of claim 21 including the steps of mounting a backing plate adjacent the one side of the combustor element in parallel, slightly spaced relation therewith, and forming a channeled configuration in said backing plate presented toward the combustor element to provide a substantially uniform fuel and air pressure distribution over the one side of the combustor element.

26. The method of claim 25 including the step of providing a channeled insulating overlay between the backing plate and the combustor element.

27. The method of claim 21 including the step of forming the combustor element from a high temperature, porous ceramic material.

28. The method of claim 21 including the steps of mounting a plurality of combustor elements on said manifold, and accelerating the fuel and air toward one side of each combustor element for passage therethrough and combustion on the other side thereof at a velocity sufficient to prevent combustion flash back.

29. A radiant combustor method comprising the steps of supplying fuel and air under pressure to a dual manifold having a fuel plenum and an air plenum; mounting a generally planar porous combustor element on said manifold; interposing an insulation layer between the manifold and one side of the combustor element; and mixing and accelerating the fuel and air with a fuel injector assembly communicating between both said plenums and the one side of the combustor element for directing the fuel and air toward the combustor element for passage therethrough and combustion on the other side thereof at a velocity sufficient to prevent combustion on said one side of the combustor element.

30. A radiant combustor method comprising the steps of supplying fuel and air under pressure to a dual manifold having a fuel plenum and an air plenum; mounting a generally planar porous combustor element on said manifold; interposing an insulation layer between the manifold and the combustor element; mounting a backing plate adjacent one side of the combustor element in parallel, slightly spaced relation therewith; forming a channeled configuration in said backing plate presented toward the combustor element; and mixing and accelerating the fuel and air with a fuel injector assembly communicating between both said plenums and the one side of the combustor element for directing the fuel and air toward the combustor element for passage therethrough and combustion on the other side thereof at a velocity sufficient to prevent combustion on said one side of the combustor element.

31. A radiant combustor assembly comprising a housing forming a manifold for receiving fuel and air under pressure; a generally planar porous combustor element; a backing plate adjacent one side of said combustor element and having a central opening for passage of fuel and air therethrough; means for maintaining said backing plate in substantially parallel, slightly spaced relation with respect to said combustor element, said maintaining means including peripheral rim means between said combustor element and backing plate at their peripheries for spacing the same from each other, a plurality of brackets received over the peripheral edges of said combustor element and backing plate, an insulation layer disposed between said combustor element and backing plate, and spring connector means for coupling said brackets to said housing under spring tension so as to draw said plate and element and insulation layer toward said housing under spring tension; and means communicating from said manifold through the central opening in said backing plate to the side of said combustor element adjacent said backing plate for directing fuel and air from said manifold toward said combustor element for passage therethrough and combustion on the other side thereof, said means including acceleration means for accelerating the fuel and air to a velocity sufficient to prevent combustion flash back, said backing plate including a channeled configuration presented toward said combustor element formed to provide a substantially uniform fuel and air pressure distribution over the adjacent side of said combustor element.

* * * * *